United States Patent [19]

Liester

[11] Patent Number: 4,738,448

[45] Date of Patent: Apr. 19, 1988

[54] SUPPORT ASSEMBLY FOR A BASKETBALL BASKET AND BACKBOARD

[76] Inventor: Arvin F. Liester, 2515 La Salle St., Colorado Springs, Colo. 80909

[21] Appl. No.: 12,879

[22] Filed: Feb. 9, 1987

[51] Int. Cl.[4] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 1,757,350 | 5/1930 | Wallace . | |
| 1,778,173 | 10/1930 | Steele . | |
| 2,313,188 | 3/1943 | Woodburn | 273/1.5 |
| 2,571,061 | 10/1951 | Reynolds | 242/156 |
| 2,712,445 | 7/1955 | Barclay et al. | 273/1.5 |
| 2,742,843 | 4/1956 | Redetzke | 97/198 |
| 2,757,882 | 8/1956 | Maitland | 242/156 |
| 2,837,299 | 6/1958 | Cusack | 242/156 |
| 2,877,963 | 3/1959 | Hayden | 242/156 |
| 2,881,003 | 4/1959 | Drew | 273/1.5 |
| 2,923,493 | 2/1960 | Fitzgerald et al. | 242/156 |
| 3,012,781 | 12/1961 | Nelson | 273/1.5 |
| 3,089,665 | 5/1963 | Gardner, Jr. | 242/156 |
| 3,194,555 | 7/1965 | Humphrey | 273/1.5 |
| 3,258,266 | 6/1966 | Kamish | 273/1.5 |
| 3,427,025 | 2/1969 | Procter | 273/1.5 |
| 3,462,143 | 8/1969 | Bidelman et al. | 273/1.5 |
| 3,534,956 | 10/1970 | Myers | 273/1.5 |
| 3,586,324 | 6/1971 | Bearson | 273/1.5 |
| 3,598,406 | 8/1971 | Robinson | 272/61 |
| 3,669,450 | 6/1972 | Mason | 273/1.5 R |
| 3,765,676 | 10/1973 | Bearson et al. | 273/1.5 R |
| 3,795,396 | 3/1974 | Kropelnitski | 272/59 C |
| 3,802,702 | 4/1974 | Pulley | 273/1.5 R |
| 3,881,724 | 5/1975 | Beveridge | 273/1.5 R |
| 4,111,420 | 9/1978 | Tyner | 273/1.5 R |
| 4,151,989 | 5/1979 | Dittrich | 273/1.5 A |
| 4,365,802 | 12/1982 | Ehrat | 273/1.5 R |
| 4,395,040 | 7/1983 | White | 273/1.5 R |
| 4,433,839 | 2/1984 | Simoneeth | 273/1.5 R |
| 4,438,923 | 3/1984 | Engle | 273/1.5 R |
| 4,441,709 | 4/1984 | Schroeder et al. | 273/1.5 R |
| 4,465,277 | 8/1984 | Dittrich | 273/1.5 A |
| 4,483,534 | 11/1984 | O'Donnell | 273/1.5 R |
| 4,494,710 | 1/1985 | Harris et al. | 242/156 |
| 4,526,367 | 7/1985 | Hasten et al. | 273/1.5 R |
| 4,534,556 | 8/1985 | Eastland et al. | 273/1.5 R |

OTHER PUBLICATIONS

Commercial Literature-Basketball Products International, Inc., Seattle, WA-1986-20 pages.

*Primary Examiner*—Paul E. Shapiro

*Attorney, Agent, or Firm*—Norvell E. Von Behren

[57] ABSTRACT

A support assembly for use in controlling basketball dunk shots at all height settings of the goal. The support assembly, upon which is mounted the basketball basket and backboard, controls a downward dunking force and then returns at a slower controlled rate to its original position. The assembly may also control a forward dunking force, from a player approaching the basket from a center court position, during a dunk shot and then returns the assembly at a slower controlled rate upon completion of the dunk shot. The assembly may also be used to control a sideways force occurring from a dunk shot when a player hits the basket from the side court. When this happens the support assembly will rotate to absorb the dunking force and then will return to its original position at a slower controlled rate.

20 Claims, 4 Drawing Sheets

SUPPORT ASSEMBLY FOR A BASKETBALL BASKET AND BACKBOARD

BACKGROUND OF THE INVENTION

This invention relates generally to a support assembly for a basketball basket and backboard, and in particular, relates to a novel support assembly which permits movement of the basket and backboard in at least one direction and also in a plurality of directions as desired by the purchaser of the support assembly.

The basket and backboard used in the game of basketball is generally positioned vertically at each end of a basketball court. The basket is fixedly attached to the vertical backboard and is subject to many forces thereon during the playing of the game. With the advent of professional basketball as a national sport, a practice known as "dunking" the ball has emerged. The professional players will often force the basketball downwardly through the basket in various manners in a display of their professional abilities. Many times, the basketball player will race toward the basket, prior to the dunk shot from various directions on the floor and effect the dunk shot with increased multi-directional forces on the basket and backboard.

As a result of this practice which is acceptable due to the entertalnment nature of the sport, the increased forces on the basket and backboard can cause injury to the player should the basket or backboard collapse or be forced out of its original position during the dunk shot.

The problem becomes increasingly more dangerous as college basketball players emulate their professional counterpart and high school players do the same. In other words, more and more basketball players are using the dunk shot not only for its theatrical effect, but also as another means of getting the basketball into the basket as rapidly as possible during a basketball game. The applicant's invention makes it possible for very young players to practice their dunking skills.

In order to minimize the danger of injury to the dunking basketball player and to provide a support assembly that will control and resist or dampen the dunklng forces, there must be understood the major forces resulting from a dunk shot. Should the dunking player drive at the basket from the center of the floor and exert a dunk shot, then the force on the basket and backboard can be a combination of a vertically downwardly force caused by the player hitting or holding onto the basket on completion of the dunk shot and can also be a horizontally inwardly force caused by the forward momentum as he hits the basket and backboard with hls arms. Should a dunk shot be attempted from the side of the court by driving towards the basket parallel to the backboard, then the dunking force can be a combination of a vertically downwardly force as before mentioned in combination with a horizontally rotational force caused by the player hitting the basket parallel to the backboard, causing a rotational moment on the supporting structure. In other words, the entire supportlng structure will tend to want to rotate around a fixed point holding the structure in its origlnal position.

To further complicate the problem of designing a universal support assembly for use in dunking a basketball, should the basketball player approach the basket at a 45° angle towards the basket, then at least three forces are involved during the dunk shot. The previously mentioned vertically downward forces caused by the player hitting the basket and the horizontally inwardly forces caused by driving at the basket from a 45° angle to the line of the basketball court, are encountered and are added to the horizontally rotational force caused by the 45° approach to the basket.

It is known in prior art design of mechanical devices to provide means using reels, spindles, tension on lines, etc. to dampen or control various motions as typified in the U.S. Pat. Nos. 2,571,061, issued to E. W. Reynolds; 2,757,882, issued to F. A. Maitland; 2,877,963, issued to A. P. Hayden., 2,923,493, issued to T. C. Fitzgerald et al; 3,089,665, issued to A. E. Gardner, Jr.; 4,494,710, issued to M. J. Harris et al: and 2,837,299, issued to G. U. Cuscak.

In the prior art design of basketball basket and backboard support assemblies, it is known to provide a variety of support structures and suspension devices as typified in the U.S. Pat. Nos. 1,757,350, issued to W. Wallace; 1,778,173, issued to A. L. Steele, and 2,712,445, issued to J. Barclay et al.

The design adjustable heights above the basketball floor for a basket and basket board as well as resilient mounted baskets attached to the backboard to dampen stresses on the basket and backboard are taught in the U.S. Pat. Nos. 4,395,040, issued to D. White; 4,483,534, issued to J. F. O'Donnell; 4,438,923, issued to C. J. Engle et al; 4,441,709, issued to E. A. Schroeder et al; 4,534,556, issued to P. D. Eastlund et al; 2,313,188, issued to C. C. Woodburn and 4,365,802, issued to A. H. Ehrat.

The prior art discloses several configurations directed specifically to the problem of providing a device for dampening several of the forces of a dunk shot as typified in the U.S. Pat. Nos. 4,151,989, issued to W. A. Dittrich and 4,465,277, issued to the same inventor. These patents, springing from a single patent application, address the problem of a horizontally rotationally directed dunk shot force and also a horizontally inwardly directed dunk shot force of the type hereinbefore described. For the reasons to be more fully stated hereinafter, these embodiments do not protect the basketball player from injury as does the applicant's novel invention, and in particular do not address the problem of the complex multi-forces on a basket and backboard coming from various directions during a fast approach and dunk shot by a professional player. For further reference to other background patents relating to various prior art devices of the type hereinbefore described, the prior art cited by the Examiners in these two patents may be helpful to the reader who desires more information.

The commercialization of various devices designed for solving the problem of minimizing the forces from a slam-dunk by a basketball player are shown in the commercial literature printed by Basketball Products International, Inc. of 309 South Cloverdale Street, D-9, Seattle, WA 98108, filed with prior art cited in this application. This literature shows in more detail the problems encountered when a basketball player forceably dunks a basketball and presents various solutions to overcome the resulting forces.

A basketball rim assembly to relieve dunking forces is shown in U.S. Pat. No. 4,433,839 and a height adjustable goal is shown in U.S. Pat. No. 4,526,367.

SUMMARY OF THE INVENTION

In order to overcome the problems inherent in the various devices hereinbefore described, there is provided by the applicant's invention, a new and novel upstanding support assembly for holding a basketball basket and backboard with the assembly being specifically designed for use by a basketball player in safely dunking a basketball without injury to himself.

The applicant's novel support assembly may be used to relieve dunking forces from varlous directions with the support assembly having novel control means to control the movement of the basketball basket and backboard whenever a dunking force is applied to the device. The control means relieves the forces on the basket caused oy the dunk shot and they permit the basket and backboard to automatically return to their original position at a slow, controlled rate.

The foregoing is accomplished by the use of a novel horizontal support means which is associated with an upstanding vertical support pole that may be fixedly attached to the floor or some immovable object and also to other positions. The novel horizontal support means contains at least one control means which controls one of the directional forces on the device caused by a dunk shot and relieves this force by allowing the horizontal support means to move in a pre-controlled direction and manner and to return to its original position at a slow, controlled or a dampened rate.

With the applicant's novel support assembly with the horizontal support means, there is also provided control means where control of the dunking forces may be obtained in more than one direction. For example, by the use of the applicant's novel device in it's various embodiments, vertical downward dunking forces may be absorbed, horizontal inward dunking forces may be absorbed and horizontal rotational sideways dunking forces may be absorbed and controlled in various combinations according to the desires of the purchaser of the device.

There is also provided on the applicant's novel support assembly means to preset the height of the basket to a predetermined height, thereby permitting the novel support assembly to be used by players of differing heights, such as junior high school players, high school players, college players and professional players. This allows the applicant's novel support assembly to be universally adapted for any size of basketball team from beginners to professional players.

Accordingly, it is an object and advantage of the invention to provide a new and novel support assembly that permits dunking forces to be controlled and absorbed in at least one, two or three directions or in any combination thereof.

Another object and advantage of the invention is to provide a new and novel support assembly that may be used to control and absorb dunking forces by resilient means in at least a vertical downward direction while having dampening means to slowly return the basket to its original position.

Yet another object and advantage of the invention is to provide a new and novel support assembly that may be used to control and absorb dunking forces in at least a horizontal inward direction while containing dampening means to allow the basket to return to its original position upon completion of the dunk shot in a slow controlled manner.

Yet another object and advantage of the invention is to provide a new and novel support assembly that may be used to control and absorb dunking forces in a horizontal rotational direction while containing dampening means to slow down the return of the basket as it returns to its original position.

A further object and advantage of the invention is to provide a novel support assembly that may be used for any size of basketball player and which has adjustment means to adjust the height of the backboard while also containing novel control means to control dunking forces caused by a player dunking the ball into the basket of the device.

Still another object and advantage is to allow this support to be built of lighter materials than those assemblies that are not resilient in all directions that the dunker may apply the dunking forces so that there will be less strain on the player.

It is most important to make the applicant's invention accessible to grade school players as they are developing their basic skills and they are most in need of having a better player height to goal height ratio. High school players have it but college and professional players do not have this height ratio disadvantage.

DESCRIPTION OF THE PREFERRED EMBODIMENT

Figures 1, 2, 3, 4, 5, 8:
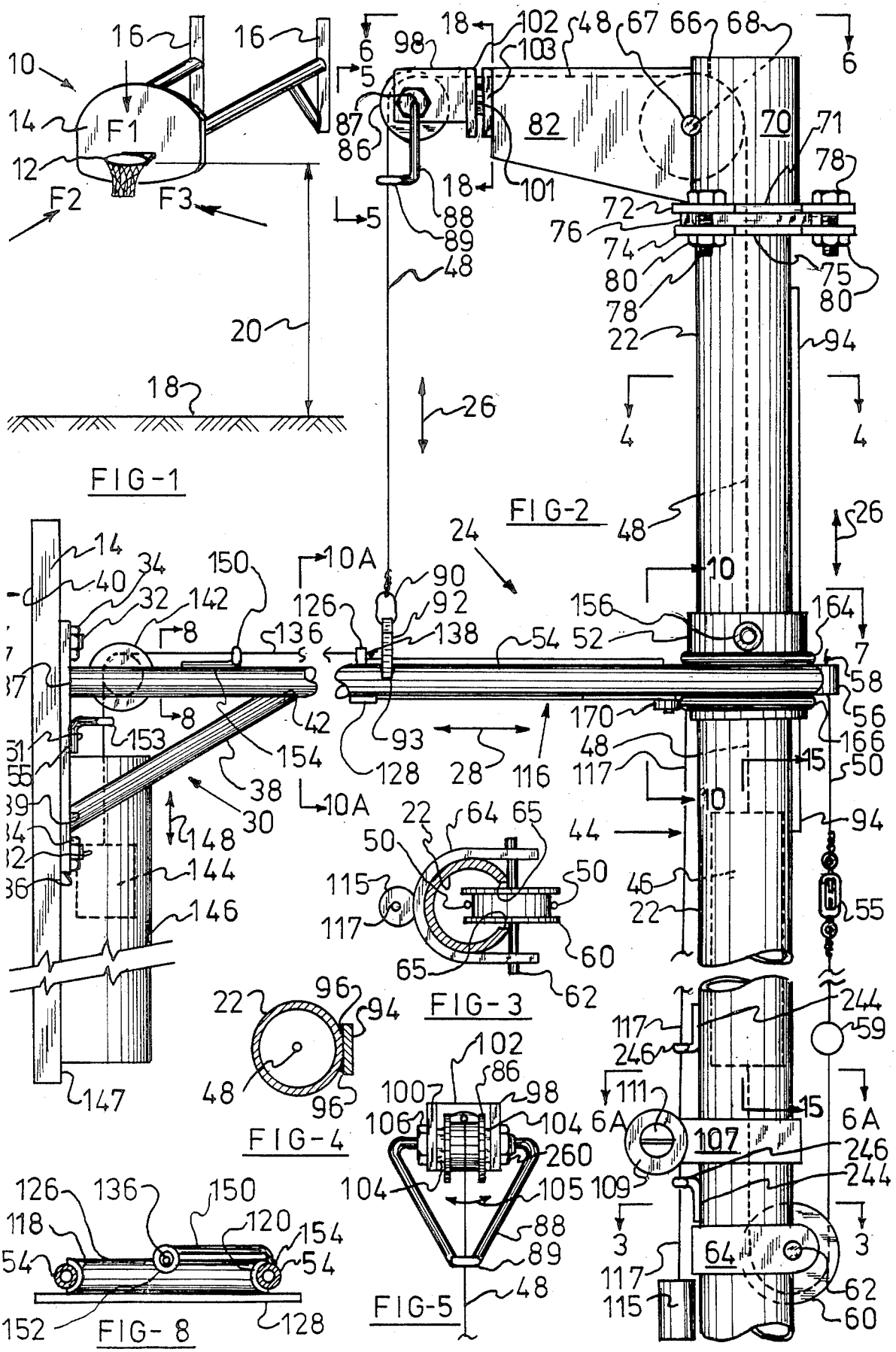
FIG. 1 is a perspective view of a typical basketball goal showing multi-directional forces applied to the goal during a dunk shot.
FIG. 2 is an enlarged partial side view, similar to the view shown in FIG. 1A, showing the various components of the applicant's novel support assembly.
FIG. 3 is a cross-sectional view, taken along line 3—3 of FIG. 2.
FIG. 4 is a cross-sectional view, taken along line 4—4 of FIG. 2.
FIG. 5 is an end view, taken along line 5—5 of FIG. 2.
FIG. 8 is a cross-sectional view, taken along line 8—8 of FIG. 2.

Referring now to the drawings in general and in particular to FIG. 1 of the drawings, there is shown a typical basketball goal, shown generally by the numeral 10, having attached thereto a basket 12 fixedly or movably attached to a backboard 14 which is in turn attached to a supporting structure 16 of various types known in the art. The basketball goal 10 is positioned above the basketball floor 18 at a predetermined height 20.

Due to the increasing frequency of modern-day basketball players to slam-dunk the basketball, it has been determined that there are at least three major forces that can be in effect on the basketball goal 10 depending upon where and how the player approaches the goal prior to the slam-dunk. For example, a force F1, as shown in FIG. 1, would be a downward force occurring from the termination of the slam-dunk as the player forces the ball through the basket 12 and then grabs onto the basket rim in order to break his momentum caused by the slam-dunk.

As a result, the basket 12 and backboard 14, along with the supporting structure 16 would have a downward force F1 applied to the various structures which can cause damage and also potential injury to the player should the structures break during the slam-dunk. When the player drives toward the basketball goal 10 from the approximate center of the court, there may be added a second force F2 as shown in FIG. 1 which is a driving force at the basketball goal 10 which tends to apply extreme pressures in the direction shown by F2 towards the supporting structures 16.

In a like manner, should the player that is attempting a slam-dunk, approach the basketoall goal 10 from the side of the court, then an additional force F3 may be introduced which will cause a rotational horizontal force on the basketball goal 10 also subjecting the goal and its various parts to possible breakage and also possible injury to the player during the slam-dunk.

Accordingly, it is important in designing a proper support assembly for a basketball basket and backboard to consider these three forces, not only by themselves but in various combinations in order to control the forces and minimize any injury to the player and also to alleviate damage to the structures of the basketball goal.

Figure 1A:
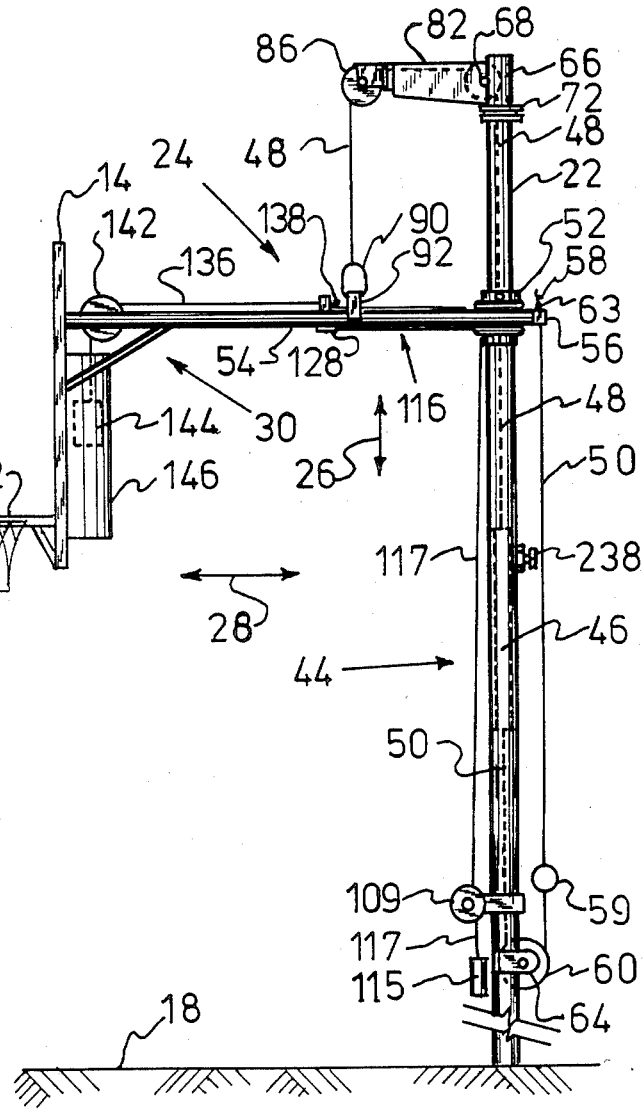
FIG. 1A is a side elevational view, showing the applicant's novel support assembly for a basket and backboard and utilized for absorbing multidirectional dunking forces and for returning the basket to its original position at a slow, controlled rate upon completion of a dunk shot.

Referring now to FIG. 1A of the drawing, there is shown a side elevational view of the applicant's novel support assembly for basketball basket and backboard which is designed to control at least one of the three forces hereinbefore described and may also be utilized to control two or three of the forces in combination as desired by the purchaser of the device.

The applicant's novel support assembly comprises a substantially upstanding vertical support pole 22 which would be fixedly attached to an immovable object at one end thereof such as the floor 18 of a basketball court. A novel substantially horizontal support means 24 would be associated with the support pole 22 and would be slideable thereon in at least a vertical manner upwardly and downwardly in the direction shown by the arrow 26. The horizontal support means 24 contains attaching means 30 which are fixedly attached to the support means to attach the basket 12 and backboard 14 to the support means.

The applicant's novel support assembly contains at least a first control means which will be described more fully hereinafter which controls the vertical sliding movement upwardly and downwardly in the direction shown by the arrow 26 in order to relieve the downward force on the basket 12 when a force such as F1 (as shown in FIG. 1) is applied to the basket. The novel first control means automatically returns the basket and backboard to its original position upon completion of the dunk shot in a controlled manner, thereby minimizing any harm to the player caused by the effect of the dunk shot.

The novel horizontal support means 24 is also movable in a horizontal direction as shown by the arrow 28 inwardly and outwardly towards and away from the support pole 22 in order to control the inward horizontal movement of the support means and the attached basket and backboard during a dunk shot caused by a force F2 (as shown in FIG. 1). The means for controlling the movement inwardly and outwardly of the basket and backboard during a dunk shot will be described more fully hereinafter and will be referred to as the second control means which allows the movement of the basket and backboard to be controlled and returned to its original condition in a controlled manner.

The applicant's novel support assembly may also be designed to incorporate the feature to control, by a third control means to be described hereinafter, the force caused by a dunking player when hitting the support assembly from the side of the court as shown by the force F3 in FIG. 1. As a result, the applicant's novel support assembly may be designed to control at least one force on the assembly and may also be used to control a second or third force of the type shown in FIG. 1 or variations thereof, depending upon the particular embodiments and mechanisms desired and purchased by the user of the device.

Referring now to FIG. 2 of the drawing, there will be described in more detail the various control means hereinbefore mentioned, and how they function to provide the necessary control of the dunking forces. FIG. 2 is an enlarged side view, similar to the view shown in FIG. 1A, and shows how the attaching means 30 utilizes a plurality of bolts 32 and nuts 34 to attach the basket 12 and backboard 14 to the horizontal support means 24. For purposes of clarity, the basket 12 is not shown attached to the front surface 40 of the backboard. A pair of vertical brackets 36 would be attached to a pair of sloped brackets 38 and would be welded as shown at 37, 39 and 42 to the horizontal support pole 54 to provide the necessary support to the basketball goal.

Figures 6, 7, 9, 13, 14:
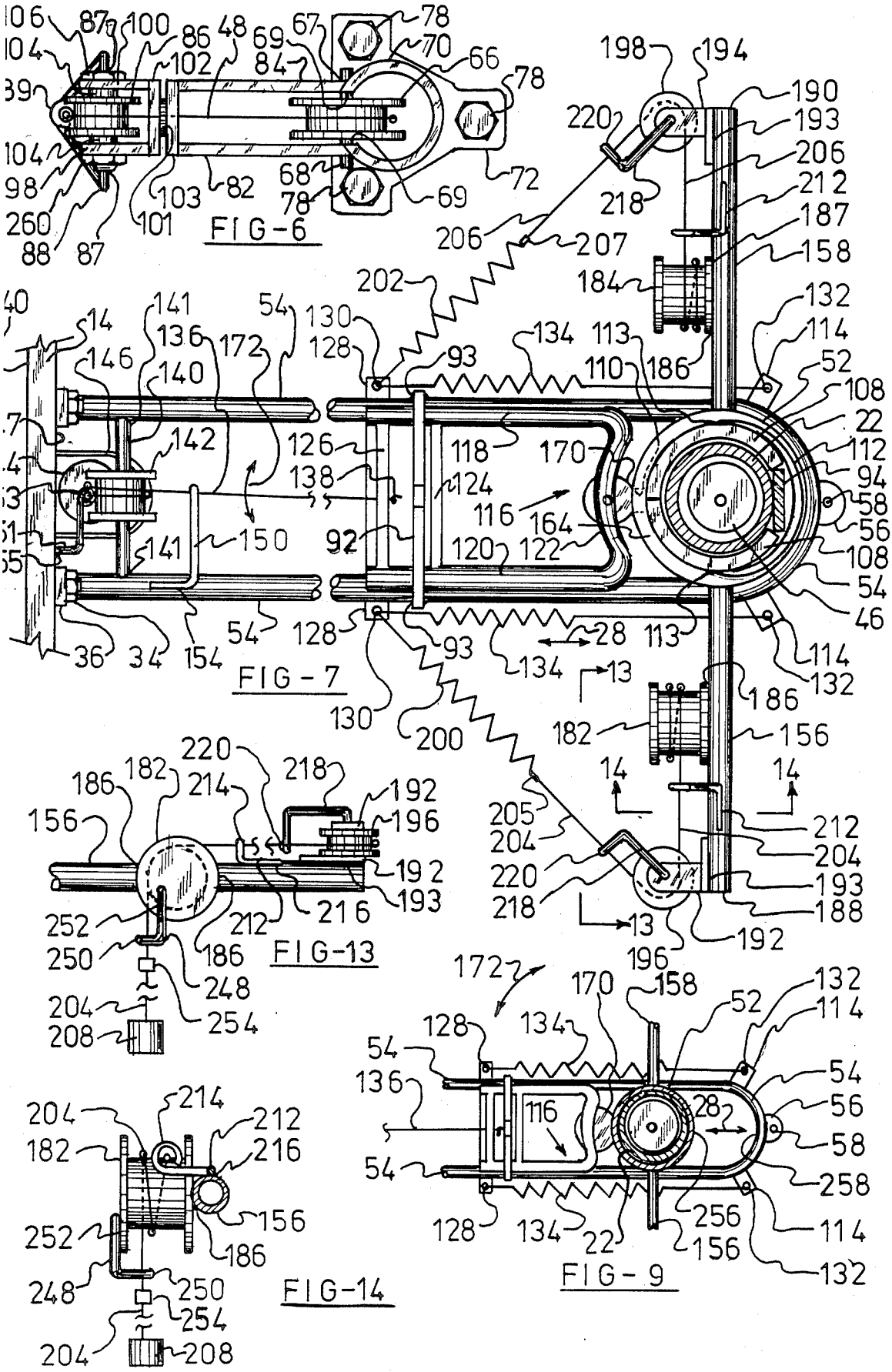
FIG. 6 is a top plan view, taken along line 6—6 of FIG. 2.
FIG. 7 is a cross-sectional plan view, taken along line 7—7 of FIG. 2.
FIG. 9 is a plan view, similar to a portion of the FIG. 7 view, showing in somewhat of a schematic form the various components used in the applicant's device.
FIG. 13 is a side view, taken along line 13—13 of FIG. 7.
FIG. 14 is a cross-sectional view, taken along line 14—14 of FIG. 7.

The horizontal support pole 54 may be formed in a one-piece configuration and would be formed generally in a U-shaped configuration as shown in FIG. 7 of the drawing.

By referring now to both FIGS. 1A and 2 of the drawing, there will be described in more detail how the applicant's novel horizontal support means 24 moves upwardly and downwardly as shown by the arrow 26 to control dunk forces applied to the basketball goal. As has been described before, the applicant's novel invention contains a first control means which is associated with the support pole and the support means for controlling the vertical sliding movement of the support means and the attached basket and backboard in a predetermined manner downwardly during a dunk shot.

The first control means is shown generally by the arrow 44 and comprises in part a counterweight assembly 46 which is positioned within the support pole 22 and is attached to an upper cable 48 and a lower cable 50. The counterweight assembly 46 will be described in more detail when referring to FIG. 15 of the drawings hereinafter. The lower cable 50 is attached at 51, shown in FIG. 15, to an internal weight 227 and is positioned around a lower pulley 60 attached to an axle 62, which is in turn attached to the axle support bracket 64 surrounding the vertical support pole 22.

It can be seen in FIG. 2 also how the end 58 of the lower cable 50 is terminated at a cable support 56 and fixedly attached thereto which will be described more in detail when referring to FIG. 7. A cable adjustment turnbuckle 55 may be positioned below the cable support 56 in the cable 50 to level the horizontal support means 24.

Figure 15:
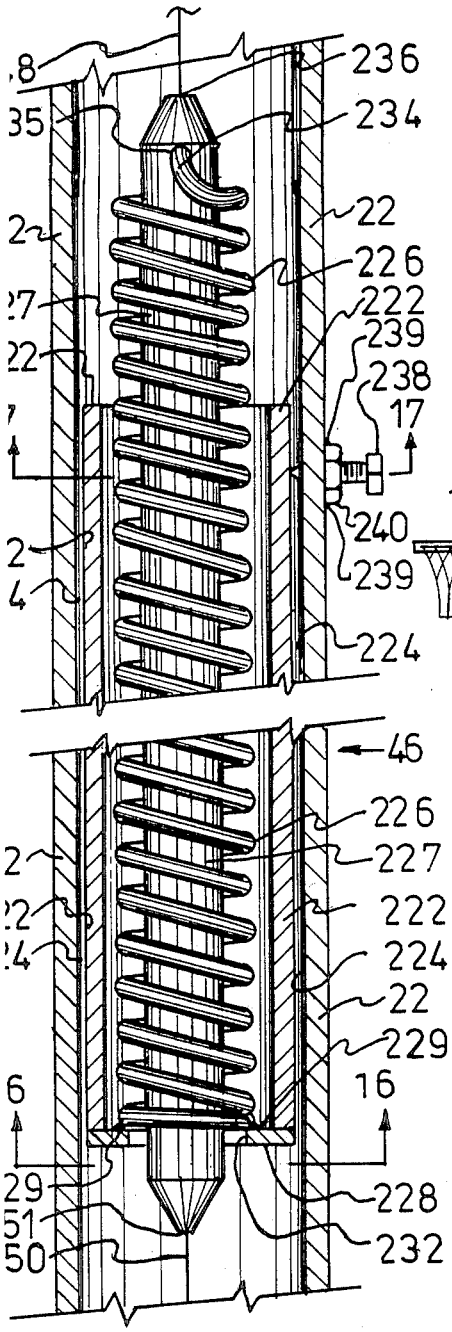
FIG. 15 is a cross-sectional view, taken along line 15—15 of FIG. 2.

The upper cable 48 is fixedly attached to the inner weight 227, as shown in FIG. 15 at 236 and is positioned around an upper pulley 66, partially positioned within the axle support bracket 70, and attached thereto by an axle 68 which is in turn fixedly attached to the axle support bracket 70. A support bracket flange 72 may be welded at 71 to the axle support bracket 70. A matching vertical support pole flange 74 may be welded at 75 to the vertical support pole 22. A spacer 76 may be positioned between the flanges 72 and 74 and would have a plurality of bolts 78 and nuts 80 positioned through drilled holes therein, which are not shown in the drawings. The plurality of bolts 78 and nuts 80 would then rigidly attach the axle support bracket 70 to the top portion of the vertical support pole 22.

A pair of support bracket arms 82 and 84 would be fixedly attached to the axle support bracket 70 by weld or some other known means and would be used to support the swivel pulley 86 on the pair of pulley support arms 98 and 100, as shown in FIGS. 2 and 6. This would allow the upper cable 48 to be carried by the swivel pulley 86 and to be attached to the horizontal support pole 54 by means of the cable tie 90 fixedly attached to the bracket 92, which is in turn welded to the horizontal support 54 at 93, as shown in FIGS. 2 and 10A.

A vertically positioned elongated bar 94 would be welded to the back portion of the vertical support pole 22 and would be designed to allow a support bracket 52 to ride upwardly and downwardly as will be described hereinafter without rotating around the vertical support pole 22. It can then be seen, when referring to FIGS. 1A and 2 of the drawings, how a downward force such as a force F1, as shown in FIG. 1, would allow the basketball goal 10 with its attached basket 12 and backboard 14 to move downwardly and upwardly due to the particular arrangement of the first control means 44 in the form of the internal counterweight 227 and the various cables 48 and 50 positioned around the various pulleys 60, 66 and 86. In other words, a downward force by a dunk shot will allow the basketball goal 20 to slide downwardly on the vertical support pole 22 with the first control means controlling the downward movement and subsequent upward return of the basketball goal as will be described more fully hereinafter.

Referring now to FIG. 3 of the drawing, there is shown a cross-sectional view, taken along line 3—3 of FIG. 2, showing how the lower pulley 60 would be positioned partially within the vertical support pole 22 and partially outside of the support pole and would be rotatably held thereon by means of the axle 62 positioned through the axle support bracket 64. An elongated slot 65 would be cut in the vertical support pole 22 to allow the pulley 60 to be partially positioned within the support pole 22 and partially on the outside as shown in FIGS. 2 and 3. It can also be seen in FIG. 3 how the lower cable 50 is positioned around the lower pulley 60.

A rubber ball 59 may be positioned on the lower cable 50 on the outside of the vertical support pole 22 as shown in FIG. 2 and may be used to manually raise or lower the height of the basketball goal 20 as will be described more fully hereinafter when referring to FIG. 17. The rubber ball 59 then allows a person to grasp the lower cable 50 without having to touch the cable and to pull upwardly or downwardly on the cable to manually set the original height of the basket for various sized basketball players.

Referring now to FIG. 4 of the drawing, there is shown a cross-sectional view, taken along line 4—4 of FIG. 2, showing in more detail how the elongated bar 94 would be welded at 96 on both sides thereof to the vertical support pole 22, thereby allowing the support bracket 52 to move upwardly and downwardly in the direction shown by the arrow 26, as will be described more fully hereinafter.

Referring now to FIG. 5 of the drawing, there is shown an end view, taken along line 5—5 of FIG. 2, showing in more detail how the pulley 86 would be positioned between the pair of pulley support arms 98 and 100 which in turn would be fixedly attached by welding or some other means to a plate 102. A matching plate 103 would be positioned against the plate 102 and have contained therebetween swivel means 101 to allow pulley 86 to swivel. The plate 103 would be rigidly attached to the ends of the support bracket arms 82 and 84 by welding or some other suitable means. In this manner, by the use of the swivel means 101, the pulley 86 may be designed to rotate in the direction shown by the arrow 105 whenever the applicant's novel support assembly would rotate in a horizontal manner should a force F3 be applied to the support assembly as will be more fully described hereinafter.

Figure 18:
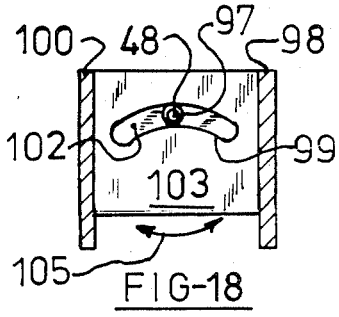
FIG. 18 is an enlarged cross-sectional view taken through lines 18—18 of FIG. 2.

Referring now to FIG. 18, there is shown how the plate 102 is free to rotate or swivel in the direction shown by the arrow I05 when a force F3 is applied to applicant's novel device. A curved slot 99 would be cut in the fixed plate 103 while a hole 97 would be cut in the swivel plate 102. When formed in this manner, the upper cable 48 would pass through the hole 97 and through the curved slot 99. The upper cable 48 would also be positioned above the swivel means 101 as can be seen in FIGS. 2 and 6.

Since the swivel plate 102 is able to rotate in the direction shown by the arrow 105 on the swivel means 101, then the upper cable 48 would not be interfered with since the curved slot 99 has been utilized. The swivel means 101 may be formed of a swivel bearing or some other similar construction within the spirit and scope of the invention.

The swivel pulley 86 is formed with a hollow pulley axle 104 which is positioned between the pulley support arms 98 and 100. A bolt 106 is positioned through holes (not shown) in the support arms 98 and 100 and through the hollow pulley axle 104. A nut 260 holds the unit together. A hole 87 is drilled in both ends of the bolt 106 and holds the ends of the wire guide 88. A wire guide loop 89 is formed on the bottom of the wire guide 88 as can be seen in FIGS. 2, 5 and 6. Other supporting means and methods may be used within the spirit and scope of the invention which would allow the pulley 86 to be positioned and be free to rotate in the direction shown by the arrow 105.

Referring now to FIG. 6 of the drawing, there is shown a top plan view, taken along line 6—6 of FIG. 2, showing in more detail how the pulley 86 and the upper pulley 66 are positioned in order to support and guide the upper cable 48 in controlling the upward and downward forces shown by the arrow 26. The upper pulley 66 would be positioned partially within the axle support bracket 70 within an elongated slot 69. The support pulley 66 would also be partially contained between the support bracket arms 82 and 84 and would be rotatably positioned thereon on the axle 68 positioned through a pair of holes 67 drilled therein.

Referring now to FIGS. 1A and 2 of the drawings, there will be described how the applicant's novel invention serves to control the upward movement of the basketball goal upon the completion of a dunk shot. As has been before described, whenever a basketball player attempts a dunk shot in the direction shown by the arrow F1 in FIG. 1, the entire support assembly will move downwardly in the direction shown by the arrow 26 and at the completion of the dunk shot, the entire assembly will move upwardly in a controlled manner. This upward controlled motion is at a slower rate and is dampened in order to prevent the entire assembly from slamming back to its original position causing injury to the player or to the supporting structure. A cable 117 is fixedly attached at its upper end to the support bracket 52 which will be described more fully hereinafter when referring to FIGS. 10 and 11 of the drawing and is wrapped around a fixed capstan 109 and is then attached to a weight 115 as shown in FIG. 1A and 2 of the drawings.

Figure 6A:
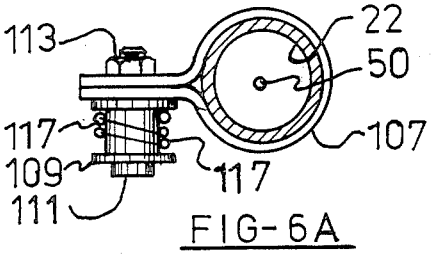
FIG. 6A is a cross-sectional view, taken along line 6A—6A of FIG. 2.

By referring to FIG. 6A of the drawings, there is shown a cross-sectional view, taken along line 6A—6A of FIG. 2, showing the attachment of the capstan to the vertical support pole 22. A capstan support bracket 107 is wrapped around the vertical support pole 22 and is formed in the configuration shown in FIG. 6A. An elongated bolt 111 is positioned through the capstan 109 and through the capstan support bracket 107 through drilled holes not shown in the drawing and is fixedly attached thereto by means of the nut 113. The cable 117 may then be wrapped around the capstan 109 a plurality of times as desired to produce the necessary frictional drag o the return.

In order to keep the cable 117 from crossing over on the capstan, a pair of wire guides 244 are fixedly attached to the vertical support pole 22 as shown in FIG. 2 of the drawing. The wire guides 244 have wire guide end loops 246 through which the cable 117 is threaded, thereby keeping the cable positioned on the capstan 109.

When a dunk shot is initiated, the applicant's novel supporting structure will move downwardly in a controlled manner in the direction shown by the arrow 26. The weight 115 will also pull the cable 117 around the capstan 109. At the completion of the dunk shot, the novel supporting structure will move upwardly in the direction shown by the arrow 26, but in a slow controlled or dampened manner to be returned to its original position. As will be described more fully hereinafter, the internal counterweight control means 44 will pull the basketball goal back to its original position with the weight 115 serving to slow down the upward motion. Since the weight 115 is attached to the cable 117 which is in turn wrapped around the capstan 109, the friction on the capstan in combination with the weight 115 will serve to slow down the upward movement of the basketball goal so that it does not rapidly return to its original position causing harm to the player or damage to the supporting structures. The upward dampening achieved by the capstan 109 may be controlled by the number of wraps around the capstan in combination with the weight 115 in a known manner known in the art of capstan design.

Referring now to FIG. 7 of the drawing, there will be described in more detail how the support bracket 52 may slide upwardly and downwardly in the direction shown by the arrow 26 on the vertical support pole 22. FIG. 7 is a cross-sectional view, taken along line 7—7 of FIG. 2 and shows also the second control means for controlling the inward horizontal movement of the support means and the third means for controlling the rotational horizontal movement of the support means which will be described more fully hereinafter. A split housing 108 is formed and positioned around the vertical support pole 22 and contains an open slot 110 whose function will be described more fully hereinafter. The split housing 108 is designed to be positioned on each side of the elongated bar 94 and forms a part of the support bracket 52 which is designed to ride upwardly and downwardly on the vertical support pole 22. The split housing 108 is positioned on each side of the vertical support pole 22 and is designed to slideably engage the elongated bar 94 thereby allowing the support bracket 52 to move upwardly and downwardly as shown by the arrow 26, but not to rotate around the vertical support pole 22 in the direction shown by the arrow 172 in FIG. 7. A C-shaped outer housing 112 would be fixedly attached by welding at 113 to the split housing 108 after assembly in order to totally contain the support bracket 52 on the vertical support pole 22.

There will now be described in more detail how the horizontal support means 24 is formed and in particular how the support bracket 52 and the horizontal support pole 54 are utilized to carry the basketball basket 12 and backboard 14 on the applicant's novel device. It will be understood at this point that the various supporting structures that are used to carry the basket 12 and backboard 14 are designed to move upwardly and downwardly on the vertical support pole 22 and in addition may also move inwardly and outwardly on the support pole 22 in the direction shown by the arrow 28 if desired. In addition, the basket 12 and backboard may rotate around the vertical support pole 22 in the direction shown by the arrow 172 in FIG. 7 if desired. The rotation is around the support bracket 52 and pole 22 which does not rotate. Accordingly, when understanding the motion of the various parts as shown in FIG. 7 and the other figures to be described hereinafter, it should be understood that the various parts can slide upwardly and downwardly on the vertical support pole 22 in the direction shown by the arrow 26 and can also slide inwardly and outwardly on the vertical support pole 22 in the direction shown by the arrow 28 and will also rotate horizontally around the vertical support pole 22 in the direction shown by the arrow 172.

Referring now to FIGS. 7, 9, 10 and 11, there will be described in more detail how the applicant's novel supporting structure may move inwardly and outwardly as shown by the arrow 28. As has been before mentioned, the horizontal support means 24 may comprise a single horizontal support pole 54 which is formed in the U-shaped configuration and is wrapped around the support bracket 52. When formed in this configuration and when particularly referring to FIG. 7 and 9, it can be seen that an inward force in the direction shown by the force F2 of FIG. 1, will cause the horizontal support pole 54 to move to the position shown in FIG. 9 of the drawing. A pair of flanges 114 are attached to the horizontal support pole 54 and have drilled therein a pair of holes 132. A pair of springs 134 are utilized to resist the inward force F2 as will be described more fully hereinafter. In order to adequately support the basketball goal in its original position, there is positioned an upper ring 164 and a lower ring 166 which are welded at 168 to the split housings 108 forming the support bracket 52 shown more fully in FIG. 10 of the drawing. When formed in this manner, the U-shaped horizontal support pole 54 forming the horizontal support means 24 is free to horizontally move inwardly and outwardly in the direction shown by the arrow 28 in FIG. 7 being supported between the upper ring 164 and the lower ring 166. It can also be seen how the U-shaped horizontal support pole 54 would be free to rotate within the upper ring 164 and the lower ring 166 in the direction shown by the arrow 172 in FIG. 7 around the support bracket 52.

Additional support for the basketball goal is obtained, as before described by means of the upper cable 48 which is fixedly attached to the cable tie 90 and to the bracket 92 which is welded to the horizontal support pole 54 at the weld 93. This is shown in more detail in FIG. 10A of the drawing and it can be seen when attached in this manner, the upper cable 48 provides additional support to the horizontal support pole 54 in combination with the support provided by the upper ring 164 and the lower ring 166.

When formed in this manner, then it can be seen how the basketball goal can be carried in a horizontal position so that it can move inwardly and outwardly in the direction shown by the arrow 28 and can also move downwardly and upwardly as shown by the arrow 26, and can also rotate horizontally in the direction shown by the arrow 172, shown in FIGS. 7 and 9.

Positioned within the U-shaped horizontal support pole 54 is an inner sliding channel 116 which is formed with an elongated channel section 118 and an elongated channel section 120 rigidly attached or formed to an end section 122. The inner sliding channel is thereby formed in a U-shaped configuration and is designed to slide on the horizontal support pole 54 inwardly and outwardly in the direction shown by the arrow 28. However, a plastic wheel 170, is rotatably attached to the end section 122 as will be described more fully hereinafter when referring to FIGS. 11 and 12 of the drawing. The plastic wheel 170 prevents the inner sliding channel 116 from moving past the vertical support pole 22 but it is free to move in the opposite direction when functioning to dampen the outward movement of the horizontal support pole 54. An elongated bottom plate 128 is fixedly attached to the elongated channel sections 118 and 120 as shown in FIG. 10A by means of weld or some other attaching means. A pair of holes 130 are formed in the elongated bottom plate 128 and serve as a means for fixedly attaching one end of the springs 134, hereinbefore described, to the bottom plate 128.

Whenever the inward dunking force F2 is applied to the basketball goal, then the horizontal support pole 54 will move inwardly in the direction shown by the arrow 28 to the position shown in FIG. 9 of the drawing, causing the springs 144 to extend thereby controlling the inward movement. Since the inner sliding U-shaped channel 116 is restrained from further movement by the plastic wheel 170, then the springs 134 will stretch or resist the inward force F2 since the horizontal support pole 54 is free to slide within the elongated channel sections 118 and 120 as before mentioned and as shown in FIG. 10A.

It will now be described in more detail how the baskeball goal returns to its original position and how the return is slowed down or dampened to prevent the assembly from slamming into its original position and injuring a player or damaging various parts. The horizontal support pole 54 has positioned between the U-shaped legs a fixed capstan 142 which is positioned on a pipe 140 and fixedly attached thereto. The pipe 140 would be welded to the horizontal support poles 54 at 141 as shown in FIG. 7. A counterweight 144 is positioned within a counterweight cover 146 which is fixedly attached to tne backboard 14 and the back 147 of the backboard 14. The counterweight 144 is free to ride upwardly and downwardly within the counterweight cover 146 in the direction shown by the arrow 148 of FIG. 2. A cable 136 is wrapped around the capstan 142 several tImes and is positioned through a wire guide end loop 152 of the wire guide 150 and through the wire guide end loop 153 of the wire guide 151. When positioned thusly, the wire guides keep the cable 146 in a desired position so that the counterweight 144 is free to move upwardly and downwardly within the counterweight cover 146.

The wire guide 150 is fixedly attached to one arm of the horizontal support pole 54 at the weld 154 as shown in FIG. 8 of the drawings while the wire guide 151 would be fixedly attached by the weld 155 to the back 147 of the backboard 14. The end 138 of the cable 136 is positioned through a hole 137 as shown in FIG. 1OA of the drawing. The hole 137 is formed in the cross brace 126 which is fixedly attached to the elongated channel sections 118 and 120 by welds or other known attaching means. Since the cross brace 126 is welded or fixedly attached to the pair of elongated channel sections 118 and 120, which are also in turn connected to the elongated bottom plate 128, then it can be seen by referring to FIG. 10A how the U-shaped inner sliding channel 116 can slide as a complete unit on the horizontal support pole 54, which has been bent and formed into a U-shaped configuration around the vertical support pole 22.

The attaching of the end 138 of the cable 136 to the cross brace 126 through the hole 137, allows the counterweight 144 to move downwardly within the counterweight cover 146 as the entire basketball goal moves inwardly in the direction shown by the arrow 28 during a dunk shot. This occurs since the U-shaped inner sliding channel 116 is prevented from further inward movement by means of the plastic wheel 170. As the basketball goal moves inwardly, the counterweight 144 moves downwardly in the direction shown by the arrow 148 within the counterweight cover 146 as the cable 136 moves around the capstan 142. As has been before mentioned, the springs 134 attached to the elongated bottom plate 128 will resist the inward movement caused by the dunk shot force F2 until the dunk shot is complete. Thereafter, the springs 134 will tend to return the basketball goal to its original position but will be dampened or slowed down by the counterweight 144. Since the counterweight 144 had moved downwardly within the counterweight cover 146, it must then move upwardly as the basketball goal returns to its original position. However, because the cable 36 has been wrapped around the capstan 142, the combination of the friction on the capstan and the amount of counterweight 144 will slow down or dampen and control the return of the basketball goal to its original position, thereby preventing it slamming into the dunking basketball player. The degree of control of the dampening is obtained by varying the number or wraps around the capstan 142 in combination with the weight of the counterweight 144. Without the dampening using the capstan 142 and the counterweight 144, the horizontal support pole 54 would slam against the support bracket 52. In other words, the inside of the horizontal support pole 54, shown by the numeral 258 in FIG. 9 would slam against the outside of the support bracket 52 at the numeral 256 which could cause damage to the various parts.

It can then be seen in FIG. 9 how the springs 134 control the inner horizontal movement of the basketball goal during a dunk shot to relieve the forward force F2 on the basket and backboard with the springs serving as a resilient means to control the dunking force and with the counterweight 144 serving as a dampening means in combination with the capstan 142 to slow down the return of the basketball goal against the force of the springs 134.

Figure 10:
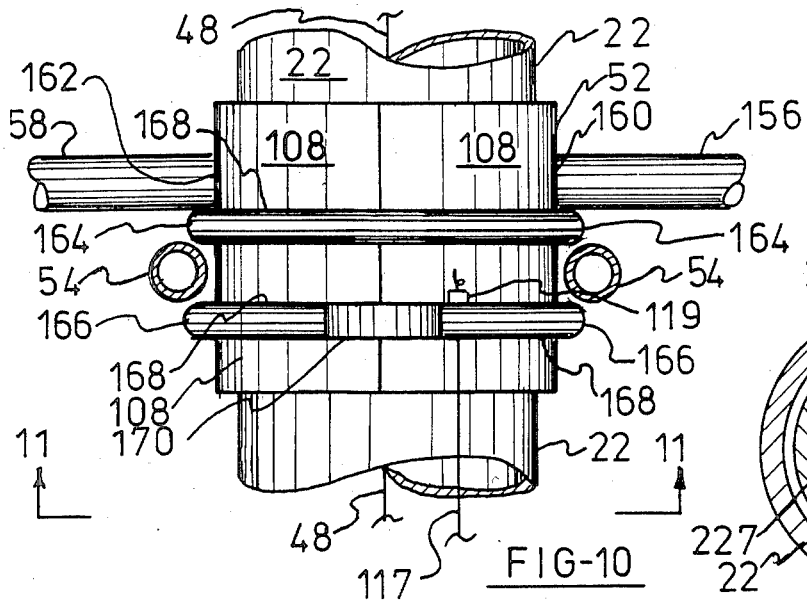
FIG. 10 is a cross-sectional view, taken along line 10—10 of FIG. 2.
Figure 11:
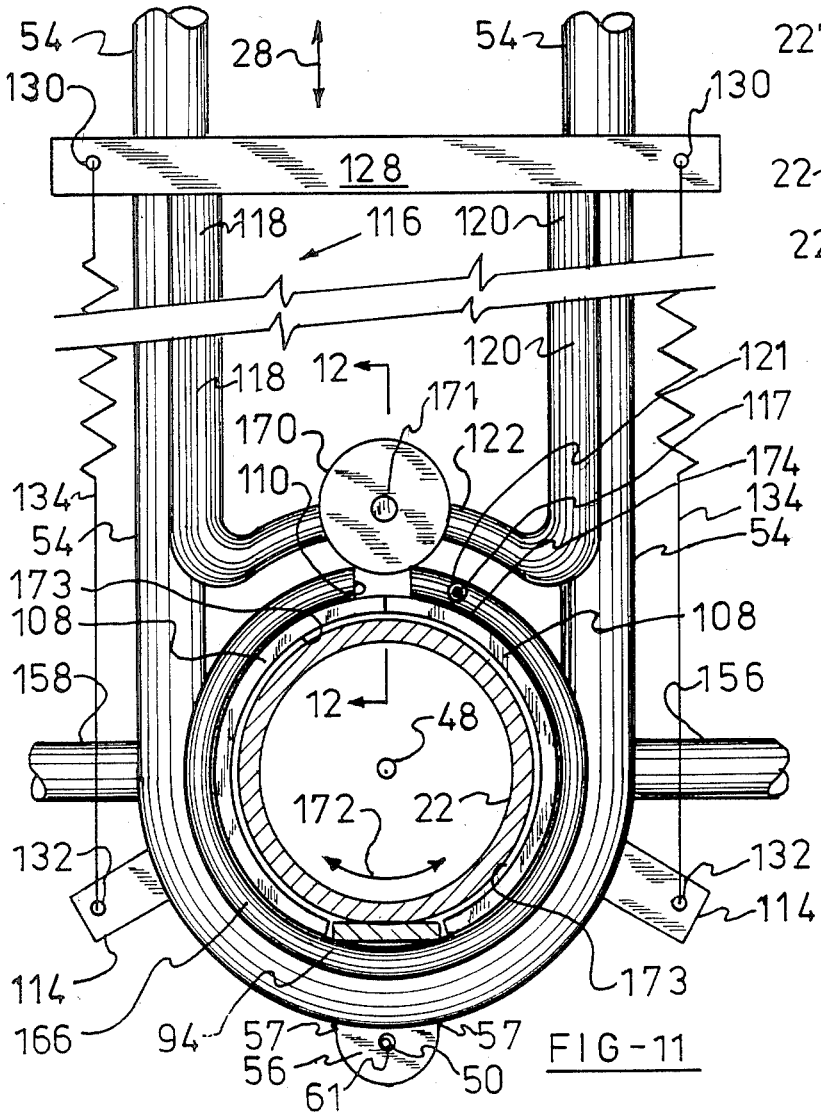
FIG. 11 is a bottom plan view in cross section, taken along line 11—11 of FIG. 10.
Figure 12:
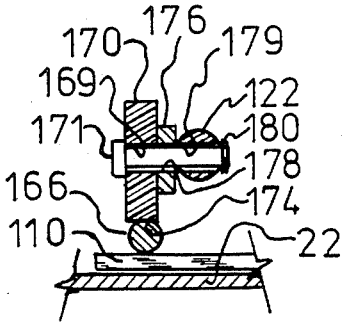
FIG. 12 is a cross-sectional view, taken along line 12—12 of FIG. 11.
Figure 10A:
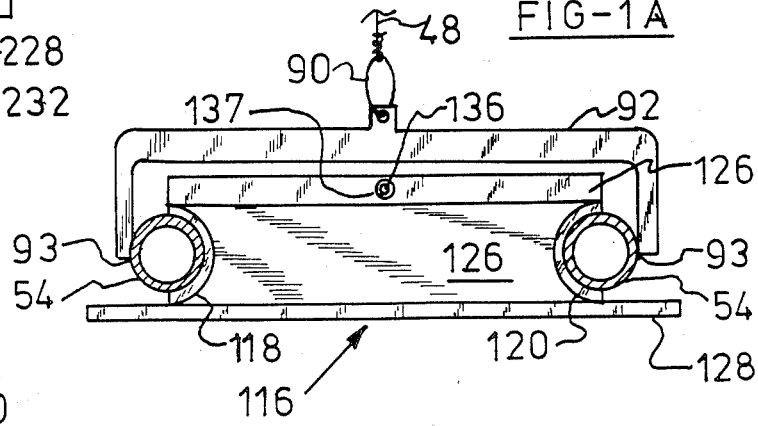
FIG. 10A is a cross-sectional view, taken along line 10A—10A of FIG. 2.

Referring now to FIGS. 10, 11 and 12 of the drawings, there will be described in more detail the novel support bracket 52 and how it allows rotation in the direction shown by the arrow 172 of FIG. 7 around the vertical support pole 22 in order to control the force F3 that may be caused by a dunk shot coming from the side court of a basketball court. As has been before mentioned, an upper ring 164 and lower ring 166 are welded to the split housing 108 forming the support bracket 52. An open slot 110 is formed in the lower ring 166 as can be seen in FIGS. 7, 10 and 11 of the drawings.

The plastic wheel 170 which is rotatably attached to the end section 122 rides out of the slot 110 and on the lower ring 166 whenever the horizontal support pole 54 rotates on the lower ring 166 during a dunk shot force F3. Upon completion of the shot, the wheel 170 will return to the slot 110. The slot 110 then forms the original or return position for the horizontal support pole 54 and U-shaped channel 116 with attached wheel 170. After a sideways force F3 has been controlled, as will be described more fully hereinafter, the basketball goal will return to its original position.

Referring to FIGS. 11 and 12, there will be seen how this is accomplished with FIG. 11 showing in greater detail the positioning of the plastic wheel 170 on its axle 171 which is in turn connected to the end section 122. The axle pin 171 is positioned through a hole 169 in the plastic wheel 170 and through a hole 178 in a spacer 176. The axle pin 171 is also positioned through a hole 179 in the end section 122 and is welded at 180 to the end section 122. When constructed thusly, the plastic wheel 170 is carried by the end section 122 and is free to rotate on the axle pin 171 as the horizontal support pole 54 rotates in the direction shown by the arrow 172 of FIG. 11. Since the U-shaped inner sliding channel 116 is free to move inwardly and outwardly in the direction shown by the arrow 28 of FIG. 11, then the plastic wheel 170 will ride out of the open slot 110 as the basketball goal rotates horizontally around the support bracket 52 during a dunk shot, caused by a force F3 as shown in FIG. 1.

There can also be seen in FIG. 11 in more detail the formation of the split housing 108 and how it is positioned around the vertical support pole 22 so that it prevents rotation of the split housing 108, which forms the support bracket 52. As has been before described, the elongated bar 94 prevents the support bracket 52 from rotating around the vertical support pole 22 however, the horizontal support pole 54 is free to rotate around the support bracket 52 within the upper ring 164 and the lower ring 166, shown in FIG. 10.

The positioning of the upper ring 164 and the lower ring 166 around the split housing 108 would be such as to allow clearance between the horizontal support pole 54 since the pole 54 stays perfectly horizontal only in its mid-range of height setting.

There can also be seen in FIG. 11 how the cable support 56 is attached by weld at 57 to the horizontal support pole 54. The lower cable 50 has its cable end 58 positioned through the hole 61 formed in the cable support 56 with the cable being tied and attached at 63 as shown more clearly in FIG. 1A. A cable adjustment for leveling the horizontal support means 24 is obtained by using a turnbuckle 55 positioned below cable support 56 as can be seen in FIG. 2.

There can also be seen in FIGS. 10 and 11 how the cable 117 before described, is attached to the support bracket 52 at the lower ring 166. A hole 121 would be drilled within the lower ring 166 and the cable 117 would be positioned through the hole and would be fixedly attached by a cable tie 119 to permanently attach the end of the cable 117 onto the support bracket 52. Thereafter, when the horizontal support pole 54 moves downwardly caused by a dunk shot force F1, then the capstan 109 is able to function in combination with the weight 115 to slow down the upward return by the dampening action of the capstan.

There has now been described how the novel horizontal support means 24 may function as desired to control a downward dunking force F1 and an inward dunking force F2 as shown in FIG. 1. There will now be described also how the novel horizontal support means 24 may function to control a sideways rotational dampening force F3 should a dunking player approach from the side court of a basketball court. Returning to FIG. 7 and viewing FIG. 7 in combination with FIGS. 13 and 14, there will be seen that there is positioned a horizontal pole 156 and a horizontal pole 158 fixedly attached to the support bracket 52. The horizontal poles 156 and 158 form a second horizontal support means which are fixedly attached to the first horizontal support means 24 as hereinbefore described. In other words, whenever the support bracket 52 moves upwardly and downwardly on the vertical support pole 22, the horizontal poles 156 and 158 will also move upwardly and downwardly. The horizontal pole 156 is welded at 160 to the split housing 108 forming the support bracket 52 while the horizontal pole 158 is welded at 162 to the split housing also. The horizontal poles 156 and 158 are positioned above the upper ring 164 and extend outwardly as shown more clearly in FIG. 7 of the drawing. A fixed capstan 182 is welded at 186 to the horizontal pole 156 while a fixed capstan 184 is welded at 187 to the horizontal pole 158. A pair of springs 200 and 202 are used to resist the rotational movement around the support bracket 52 caused by a dunking force F3 coming from a side court dunk shot in either direction. The spring 200 is fixedly attached to the hole 130 formed in the elongated bottom plate 128 and is attached to the cable 204 at the point 205 and is positioned around a pulley 196 supported by the pulley support 192 which is fixedly attached to the horizontal pole 156 by the weld 193.

In a like manner, the spring 202 is positioned through the hole 130 formed in the elongated bottom plate 128 and is attached to a cable 206 at point 207. The cable 206 is positioned around a pulley 198 which is supported by the pulley support 194 which is fixedly attached to the horizontal pole 158. The cables 204 and 206 are wrapped around their respective capstans 182 and 184 several times and are attached to weights 208 and 210. The cable 204 is attached to the weight 208 as shown in FIG. 14 and in a like manner the cable 206 is attached to a weight 210 not shown in the drawing.

It should be understood that the capstans 182 and 184 with their attached weights are similar to each other and for purposes of brevity, there has only been shown in detail the capstan 182 attached to the horizontal pole 156. These attachments are shown in FIGS. 13 and 14 of the drawing and also FIG. 7 of the drawing. A pair of wire guides 212 having wire guide end loops 214 are fixedly attached to the respective horizontal poles 156 and 158 and serve to guide the respective cables 204 and 206 on one side of their pulleys 196 and 198. In addition, a pair of wire guides 218 having wire guide end loops 220 are fixedly attached to the pulley supports 192 and 194 to guide their respective cables 204 and 206 to prevent the cables from coming off of the pulleys 196 and 198.

Referring now to FIGS. 13 and 14, there will be shown in more detail the attachment of the capstans 182 and 184 to the horizontal poles 156 and 158. The wire guides 212 are welded at 216 to the respective horizontal poles while the wire guides 218 are positioned through the pulley supports 192 and 194 and the pulleys 196 and 198. The pulley supports 192 and 194 are welded to the respective horizontal poles 156 and 158 at the weld 193. When formed thusly, the pulleys 196 and 198 will rotate on their pulley supports 192 and 194, allowing the respective cables 204 and 206 to freely rotate around the pulleys.

It can also be seen in FIGS. 13 and 14 how a wire guide 248 having a wire guide end loop 250 is positioned on each capstan 182 and 184 and is welded thereto at 252 to provide additional guides for the respective cables 204 and 206. A stop 254 is fixedly attached to the cable as shown in FIGS. 13 and 14 above the weights 208 and 210. The function of the stop 254 will be described more fully hereinafter.

Referring now to FIG. 7 of the drawing, there will be described in more detail how the applicant's novel support assembly is free to rotate in the direction shown by the arrow 172 when caused by a force F3. As a dunking basketball player approaches the basketball goal from a side court direction, he will cause a force F3 to be applied to the support assembly. If the direction of approach was from the right side of the basketball goal, then the support assembly will rotate as shown by the arrow direction 172 to the left side around the support bracket 52, stretching the spring 200 to cause a resistance to the dunking force. When this happens, the movement to the left will result in the cable 206 moving around the capstan 184, dropping the weight 210 not shown in the drawing, downwardly. At the end of the dunk shot, the spring 200 will return the support assembly to its original position against the effect of the weight 210 attached to the cable 206 and wrapped around the capstan 184. As has been before mentioned, there is attached a stop 254 to the cable 204 which hits the wire guide end loop 250 causing the spring 200 to stretch and resist the sideward force to the left caused by the dunking shot. The position of the stop 254 on the cable 204 as well as a similar stop 254 on the cable 206 will be determined in the field upon erection of the applicant's novel device. In addition, the amount of the weights 208 and 210 fixedly attached to the cables 204 and 206 and the number of times that the cables would be wrapped around their respective capstans 182 and 184 will also be determined in the field.

It can then be seen that the spring 200 will resist a dunk shot force F3 coming from the right of the basketball court looking at the basket 12 while the spring 202 will resist a dunk shot F3 coming from the left of the court. It will also then be seen how the weights 208 and 210 will serve to dampen or slow down the return of the support assembly after completion of the dunk shot. The weights and the capstans accomplish the dampening.

Figure 17:
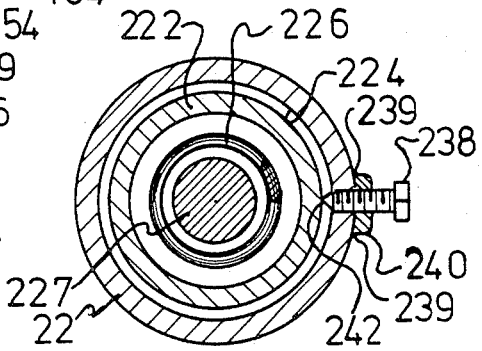
FIG. 17 is a cross-sectional view, taken along line 17—17 of FIG. 15.
Figure 16:
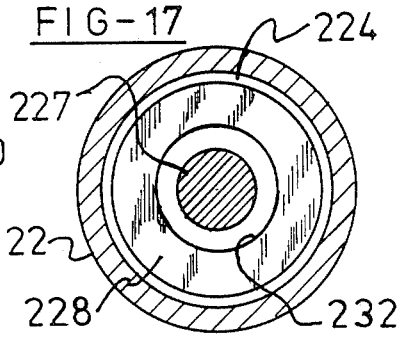
FIG. 16 is a cross-sectional view, taken along line 16—16 of FIG. 15.

Referring now to FIGS. 15–17 of the drawing, there will be described in more detail how the novel counterweight assembly 46 functions during a downward dunk shot of the type shown by the force F1 in FIG. 1 of the drawing. An inner cylindrical sleeve 222 is positioned on the inside of the support pole 22 and is designed to be sized somewhat smaller than the inside diameter of the support pole so that the inner cylindrical sleeve 222 is free to move upwardly and downwardly within the support pole. This space 224 is designed to allow for adjustment of the inner cylindrical sleeve 222 in order to adjust the height 20 as shown in FIG. 1 that the basket 12 is positioned above the floor 18.

A coil spring 226 is positioned on the inside of the inner cylindrical sleeve 222 and is grounded and welded to a bottom plate 228 which is in turn welded to the bottom of the inner cylindrical sleeve 222 as shown in FIG. 15. The bottom coil ends of the spring 226 are welded at 229 to the inside of the circular bottom plate 228. A hole 232 is formed in the circular plate 228 and is sized large enough to allow an internal weight 227 to be positioned through the hole 232 and also within the inside of the spring 226.

The upper end 234 of the spring 226 is welded at 235 to the upper end of the internal weight 227. The lower cable 50 is fixedly attached at 51 to the lower end of the internal weight 227 while the upper cable 48 is fixedly attached by known means to the upper end of the internal weight 227 at 236.

When formed thusly it can be seen that whenever a dunk shot is directed at the basket 12 in the direction shown by the arrow Fl in FIG. 1, the horizontal support pole 54 will move downwardly in the direction shown by the arrow 26. The downward motion of the horizontal support pole 54 will pull the cable 48 downwardly at the point where it is attached to the horizontal support pole and will pull the cable 48 upwardly at the point where it is attached to the internal weight 227.

As has been before described the internal cylindrical sleeve 222 is formed somewhat smaller by the amount of the space 224 than the inside diameter of the vertical support pole 22. The purpose of this is to allow for an adjustment of the internal cylindrical sleeve prior to use of the applicant's device in a basketball game. This is accomplished by means of the set screw 238 which is positioned in a nut 240 and in a drilled and tapped hole formed in the side of the vertical support pole 22. This can be seen more clearly in FIG. 17. A movement upwardly or downwardly, in the direction shown by the arrow 26, of the horizontal support pole 54 will cause the inner cylindrical sleeve 222 to also move downwardly or upwardly until the proper height of the basketball goal 10 is achieved. The nut 240 is welded at 239 to pole 22.

Thereafter the set screw 238 would be tightened within the nut 240 forcing the inner cylindrical sleeve 222 against one side of the vertical support pole 22 and would tightly hold the inner cylindrical sleeve in that position.

When held in a fixed position within the inside of the vertical support pole 22, the inner cylindrical sleeve 222 would be in essence fixed therein to allow the inner contained coil spring 226 and the internal weight 227 to function as a resistance to a dunk shot.

As has been before mentioned a downward dunk shot in the direction of the arrow F1 in FIG. 1 will cause an upward pull on the cable 48 at the point 236 shown in FIG. 15 and the combined effect of the internal weight 227 and coil spring 226 will serve to resist the dunking force. This results from the fact that the lower end of the coil spring 226 is anchored to the circular bottom plate 228, which is in turn welded to the inner cylindrical sleeve 222 fixedly held in place by means of the set screw 238, forcing the inner sleeve against the inside of the vertical support pole 22.

In experimenting with the proper sizing of the counterweight assembly 46, it has been found that a lightweight backboard 14 would weigh approximately twenty to thirty-six pounds and a typical coil spring 226 of the type used in an overhead garage door would expand at a force of seven-and-a half pounds. A larger coil spring might expand about 12 pounds and it has been found that the inner cylindrical sleeve 222 needs an adjustable setting height of four feet in order to set the height 20, of the basket 12, from six feet to ten feet which it is felt is an acceptable range. A four foot long inner cylindrical sleeve 222 would weigh approximately 12 pounds when constructed in one of the various size ranges shown in the chart below between the lines:

| Wall Thickness | SLEEVE WEIGHT IN LBS./FT. Sleeve Outside Diameter (Inches) | | | | | | |
|---|---|---|---|---|---|---|---|
| | 4" | 3¾" | 3½" | 3¼" | 3" | 2¾" | 2½" |
| 11 ga | 5.17 | 4.83 | 4.50 | 4.17 | 3.83 | 3.50 | 3.17 |
| 12 ga | 4.52 | 4.23 | 3.94 | 3.65 | 3.36 | 3.06 | 2.77 |
| 13 ga | 3.88 | 3.63 | 3.38 | 3.13 | 2.88 | 2.63 | 2.38 |
| 14 ga | 3.23 | 3.02 | 2.81 | 2.60 | 2.40 | 2.19 | 1.98 |
| 15 ga | 2.91 | 2.72 | 2.53 | 2.34 | 2.16 | 1.97 | 1.78 |
| 15 ga | 2.58 | 2.42 | 2.25 | 2.08 | 1.92 | 1.75 | 1.58 |

The coil spring 226 would need to expand as much as three feet since a player who can grab the rim of the basket 12, which has been set at a 10 foot height, would be able to reach seven foot standing on the floor. In other words, the basket 12 may move downwardly in the direction shown by the arrow 26 as much as three feet when set at a 10 foot normal playing height.

It has been calculated that the internal weight 227 should weigh about thirty pounds presuming that the horizontal support pole 54 and its various structures, along with the backboard 14 and basket 12, would weigh approximately forty-two pounds. Accordingly it is felt that an approximate length of the internal weight 227 would be five feet long when using an approximate one-and-one-half inch dianeter solid shaft as the internal weight 227. Such a shaft weighs nominally six pounds per foot while a two inch diameter shaft would weigh approximately 10.67 pounds per foot. The sizes of all of the various components of the counterweight assembly 46 would then be determined precisely after the actual weight of the horizontal support pole 54 and its various components have been determined.

The force required to start the expansion of the spring 226 must be greater than the force (weight) exerted downward by the cylindrical sleeve 222 so that the sleeve's weight will not cause the spring 226 to expand when the height adjustment set screw 238 is loosened. Much lighter construction with other materials such as plastic is anticipated using this invention.

SUMMARY OF OPERATION

From the foregoing it can be seen that there has been provided a new and novel upstanding support assembly for a basketball basket and backboard which may have one, two or three control means for controlling the forces caused by a dunk shot to allow the support assembly to resist these forces by allowing the support assembly to give or move with the forces thereby minimizing damage and injury to the player. The same control means is then used to dampen or slow down the return of the support assembly to its original position upon completion of the dunk shot. A purchaser of the novel device may incorporate one, two or all three of the control means on the support assembly at his option as they each operate from different directions independently, but may also operate together in combination when all three features are incorporated into the assembly.

A normal dunk shot causing a downward force F1 as shown in FIG. 1 will activate the first control means to allow the novel device to respond to the force by moving downward against the action of the counterweight assembly in the support pole 22. Should a forward force F2 as shown in FIG. 1 also be applied, then the support assembly will be controlled by the second control means and will move inwardly toward the support pole in a controlled manner. Upon completion of the inward force F2, the basket and backboard will return at a controlled rate to their original position. A sideward dunk shot, causing a force F3 as shown in FIG. 1, will cause the support assembly to rotate around the support pole in a controlled manner until completion of the dunk shot force, which will then result in the assembly rotating back to its original position in a slow, controlled manner. The control of the dunking forces is obtained by the various springs used in the invention in combination with the internal counterweight as a preferred embodiment. However, there are other means available within the spirit and scope of the invention to control the dunking forces in the directions F1, F2 and F3 as shown in FIG. 1. In addition the slow, controlled return of the backboard upon completion of the dunk shot will be dampened by the various capstans and counterweights used therewith and the friction encountered on the capstan wrapping. However other means are available within the spirit and scope of the invention to control the slow return and the applicant is not to be limited to the means shown which are given by way of illustration only.

It should be seen that there has been taught by the subject invention the new and novel dunk shot support assembly for a basketball basket and backboard as shown and described. Other embodiments are possible within the spirit and scope of the invention and the various parts utilized have been given only by way of illustration and the applicant is not to be limited to the exact embodiment shown. Other resilient and dampening means may be used within the spirit and scope of the invention such as air cylinders, springs, various arrangements of weights and others known in the art.

Having described my invention, I claim:

1. An upstanding support assembly for a basketball basket and backboard, the assembly being used by a basketball player to safely dunk a basketball without injury to the player, comprising:

a. a substantially vertical support pole having opposite ends and being fixedly attached to an immovable object at one end thereof;

b. a substantially horlzontal support means, associated with the support pole and slideable thereon in at least a vertical manner upwardly and downwardly;

(1) means, fixedly attached to the support means, to attach the basket and backboard to the support means; and c. first control means, associated with the support pole and the support means, for controlling the vertical sliding movement of the support means and the attached basket and backboard in a predetermined manner downwardly during a dunk shot to relieve the downward force on the basket by the dunk shot, the first control means also functioning to permit the support means and the attached backboard to automatically slide upwardly in a predetermined manner to their original position at the completion of the dunk shot;

(1) the horizontal support means and the first control means also functioning to keep the vertical motion of the backboard in a fixed straight vertical plane thereby assuring a constant distance of the entire backboard from the support pole throughout the dunk shot which prevents possible injury to the player upon movement of the backboard downwardly during a dunk shot, the backboard then slowly returning to its original position after the dunk shot.

2. The support assembly as deflned in claim 1 further comprising the horizontal support means is also movable on tne support pole ln a stralght line horizontal manner inwardly and outwardly, towards and away from the support pole, during a dunk shot, and further comprising second control means, associated witn the support means and the support pole, for controlling the inward horizontal movement of the support means and the attached basket and backboard in a predetermined manner during a dunk shot to relieve the forward force on the basket and backboard by the dunk shot, the second control means also functioning to control and permit the support means and the attached basket and backboard to automatically move outwardly in a predetermined manner to their original position at tne completion of the dunk shot.

3. The support assembly as defined in claim 2 further comprising the horizontal support means is also movable on the support pole in a rotatlonal horizontal predetermined manner around the support pole during a dunk shot and further comprises a third control means, associated with the support means and the support pole, for controlling, in a predetermlned manner, the rotational horizontal movement of the horizontal support means, away from and back to its origlnal position during a dunk shot to relieve the sideway force on the basket during a dunk shot and to automatically return the basket to its origlnal position in a predetermined manner at the completion of the dunk shot.

4. The support assembly as defined in claim 3 further comprising the third control means comprising, in part sideways resilient means for controlling the sideward rotational movement of thc horizontal support means during a dunk shot, the sideways resilient means serving also to return the horizontal support means to the original position, and further comprising dampening means, for slowing the return of the horizontal support means after completion of the dunk shot.

5. The support assembly as defined in claim 2 further comprising the second control means comprising, in part resilient means for controlling the inward horizontal movement of the horizontal support means during a dunk shot as the backboard moves towards the support pole and dampening means for controlling the outward horizontal movement of the horizontal support means, the resilient means serving to primarily return the support means to its original position while the dampening means serves to slow down the return to the original position.

6. The support assembly as defined in claim 1 further comprising the first control means comprising, in part, a weighted counterbalance means positioned within the support pole and fixedly attached by at least one cable to the horizontal support means.

7. The support assembly as defined in claim 5 wherein the weighted counterbalance comprises in part an internally positioned cylindrical sleeve.

8. The support assembly as defined in claim 7 wherein the weighted counterbalance also comprises in part a coil spring positioned within the cylindrical sleeve and fixedly attached at one end of the coil spring to a portion of the cylindrical sleeve.

9. The support assembly as defined in claim 8 wherein the counterbalance means also comprises an internal weight positioned inside the coil spring and being fixedly attached at the other end of the coil spring to the coil spring.

10. The support assembly as defined in claim 1 further comprising the first control means comprising in part, resilient means for controlling the downward vertical movement of the horizontal support means during a dunk shot and further comprises, in part, dampening means for controlling the upward vertical movement of the horizontal support means by slowing down the return to its original position, the resilient means serving primarily to return the horizontal support means to the original position after a dunk shot.

11. A basketball support assembly for supporting a basket attached to a backboard and designed to be used by a basketball player in dunking a basketball without causing injury to the basketball player or causing damage to the basket or the backboard, the support assembly also belng designed to absorb the dunking forces in at least one direction caused by the dunk, comprising:

a. a substantially vertical support pole having opposite ends and being fixedly attached at one end thereof to an immovable object;

b. a substantial horizontal support means, associated with the support pole and movable ln a predetermined manner in relation thereto in at least a horizontal manner inwardly towards and outwardly away from the support pole, the support means includlng means to rigidly attach thc backboard to the support means; and c. resilient means including dampening means, associated with the horizontal support means and the support pole, for resisting a horizontal inward force towards the support pole caused by a basketball player executing a forward dunk shot, the resilient means serving to return the backboard to its original position upon completion of the forward dunk shot and the dampening means serving to slow down the return.

12. The support assembly as defined in claim 11 further comprising the support assembly being designed to absorb the dunking forces in at least two directions and further comprising resilient and dampening means, associated with the horizontal support means and the support pole, for controlling a vertical downward force on the basket caused by a basketball player executing a downward dunk shot, the resilient means also serving to return the basket and the backboard to their original position upon completion of the downward dunk shot, the dampening means serving to slow down the return.

13. The support assembly as defined in claim 12 further comprising the support assembly being designed to absorb the dunking forces in at least three directions and further comprising resilient and dampening means, associated with the horizontal support and the support pole, for controlling a horizontal rotational force on the basket caused by a basketball player executing a side dunk shot, the resilient means also serving to return the basket and backboard to their original position upon completion of the side dunk shot, the dampening means serving to slow down the return.

14. A basketball support assembly for supporting a basket attached to a backboard and designed to be used by a baskctball player in dunking a basketball while attempting a sideways approach to the basket, the support assembly permitting a side dunk without causing injury to the basketball player or causing damage to the basket or the backboard, comprising:

a. a substantially vertical support pole having opposite ends and being fixedly attached to an immovable object at one end thereof;

b. a substantially horizontal rotatable first support means, partially positioned around the support pole and carried thereby, the first support means also having fixedly attached thereto the backboard and the basket;

c. a substantially horizontal rotatable second support means, fixedly attached to the first support means; and d. resilient and dampening means, associated with the first and second support means, for controlling the rotational movement of the basket caused by a side dunk from a basketball player, the resilient means serving to return the basket and backboard to their original position upon completion of the side dunk and the dampening means serving to slow down the return.

15. The support assembly as defined in claim 14 further comprising the resilient and dampening means comprising, in part, a pair of tension springs associated with the first support means on one end thcreof and fixedly attached at the other end thereof to a pair of cables positioned around capstans and terminating with a pair of weights.

16. In a basketball support assembly for supporting a basket and backboard, the assembly being designed to be able to dampen a plurality of multidirectional forces on the assembly caused by a dunk shot from a charging basketball player, the improvement comprising:

a. a substantially vertical support pole having opposite ends and being fixedly attached to an immovable object at one end thereof, the pole being hollow and containing therein counterbalance means;

b. a substantially horizontal support means, associated with the support pole, the support means having formed thereon a plurality of control means capable of resisting and absorbing forces caused by a dunk shot in at least one of a plurality of different directions comprising:

(1) vertically downwardly (2) horizontally inwardly (3) horizontally rotationally (4) a combination of the above different directions; and c. the control means functioning to also return the basket and backboard back to their original position upon completion of a dunk shot at a slow controlled rate.

17. The improvement as defined in claim 16 wherein one of the control means including the counterbalance means is used to set the height of the basket to a predetermined height thereby permitting the support assembly to be used by players of differing heights.

18. The improvement as defined in claim 16 wherein the counterbalance means comprises in part an internally positioned cylindrical sleeve.

19. The improvement as defined in claim 18 wherein the counterbalance means also comprises in part a coil spring positioned within the cylindrical sleeve and fixedly attached at one end of the coil spring to a portion of the cylindrical sleeve.

20. The improvement as defined in claim 19 wherein the counterbalance means also comprises an internal weight positioned inside the coil spring and being fixedly attached at the other end of the coil spring to the coil spring.

* * * * *